US010286691B2

(12) United States Patent
Chino et al.

(10) Patent No.: US 10,286,691 B2
(45) Date of Patent: May 14, 2019

(54) RECORDING APPARATUS

(71) Applicant: SEIKO EPSON CORPORATION, Tokyo (JP)

(72) Inventors: Toru Chino, Shiojiri (JP); Hideki Matsunaga, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,904

(22) Filed: Mar. 12, 2018

(65) Prior Publication Data

US 2018/0272762 A1 Sep. 27, 2018

(30) Foreign Application Priority Data

Mar. 24, 2017 (JP) ..... 2017-059258

(51) Int. Cl.

| | |
|---|---|
| ***B41J 11/70*** | (2006.01) |
| ***B65H 35/00*** | (2006.01) |
| ***B65H 35/06*** | (2006.01) |
| ***B41J 11/66*** | (2006.01) |
| ***B26D 1/24*** | (2006.01) |
| ***B65H 35/08*** | (2006.01) |

(52) U.S. Cl.

CPC ..... *B41J 11/706* (2013.01); *B26D 1/245* (2013.01); *B41J 11/66* (2013.01); *B41J 11/70* (2013.01); *B65H 35/0086* (2013.01); *B65H 35/06* (2013.01); *B65H 35/08* (2013.01); *B65H 2403/41* (2013.01); *B65H 2801/12* (2013.01)

(58) Field of Classification Search

CPC ..... B41J 11/706; B41J 11/66; B41J 11/70; B65H 35/06; B65H 35/0086

See application file for complete search history.

(56) References Cited

FOREIGN PATENT DOCUMENTS

| | | | | |
|---|---|---|---|---|
| GB | 2295584 | | 6/1996 | |
| JP | 08-156355 A | | 6/1996 | |
| JP | 08-224993 A | | 9/1996 | |
| JP | 10-181126 | * | 7/1998 | ..... B41J 11/70 |
| JP | 11-151896 A | | 6/1999 | |
| JP | 2003-320720 A | | 11/2003 | |

* cited by examiner

*Primary Examiner* — Geoffrey S Mruk
(74) *Attorney, Agent, or Firm* — Workman Nydegger

(57) ABSTRACT

There is provided a recording apparatus including: a recording unit that is configured to be capable of moving in a width direction of a medium and records an image on the medium; and a cutter unit that is configured to be connectable to the recording unit and cuts the medium by moving in the width direction, in which the recording unit has a first connection portion and a second connection portion for connecting with the cutter unit, and the cutter unit has a first engagement portion for engaging with the first connection portion and a second engagement portion for engaging with the second connection portion.

12 Claims, 11 Drawing Sheets

RECORDING APPARATUS

BACKGROUND

1. Technical Field

The present invention relates to a recording apparatus such as an ink jet type printer.

2. Related Art

There is a recording apparatus including a recording unit which records an image on a medium and a cutting mechanism which cuts the recorded medium to a desired size. JP-A-2003-320720 describes a printer including a head carriage on which a print head such as an ink jet head is mounted and a cutter carriage which has a cutter blade, as an example of a recording apparatus. The head carriage is movable in a width direction of a recording medium and the cutter carriage can be connected to the head carriage via an engagement lever. The printer of JP-A-2003-320720 is configured to cut the recording medium by moving in the width direction of the recording medium together with the head carriage in a state where the cutter carriage is connected to the head carriage by an engagement lever.

In a case of the printer described in JP-A-2003-320720, when the cutter carriage moves, since the load concentrates on the engagement lever, the engagement lever may flutter due to the load. If the engagement lever flutters, rattling is generated between the cutter carriage and the head carriage and there is a fear that the medium cannot be accurately cut.

SUMMARY

An advantage of some aspects of the invention is to provide a recording apparatus which can accurately cut a medium.

Hereinafter, means and operation effects of the invention will be described.

According to an aspect of the invention, there is provided a recording apparatus including: a recording unit that is configured to be capable of moving in a width direction of a medium and records an image on the medium; and a cutter unit that is configured to be connectable to the recording unit and cuts the medium by moving in the width direction, in which the recording unit has a first connection portion and a second connection portion for connecting with the cutter unit, and the cutter unit has a first engagement portion for engaging with the first connection portion and a second engagement portion for engaging with the second connection portion.

According to the configuration, the cutter unit and the recording unit are connected with each other by the first engagement portion engaging with the first connection portion and the second engagement portion engaging with the second connection portion. Therefore, when the cutter unit moves together with the recording unit in a state where the cutter unit and the recording unit are connected with each other, the load applied to the connection section is dispersed by the first engagement portion and the second engagement portion. In other words, the connection between the cutter unit and the recording unit can be well kept. Therefore, the medium can be accurately cut.

In the recording apparatus, it is preferable that a support member that is disposed to face the recording unit and supports the medium and a driving unit that moves the recording unit in approaching and separating direction which is a direction different from the width direction so as to change a distance between the recording unit and the support member be provided.

According to the configuration, the quality of the image recorded on the medium can be improved by changing the distance between the recording unit and the support member according to the thickness of the medium.

In the recording apparatus, it is preferable that a receiving section of the first connection portion with which the first engagement portion is in contact when the cutter unit moves in the width direction together with the recording unit have a width in the approaching and separating direction which is larger than that of the contact portion of the first engagement portion which is in contact with the receiving section.

According to the configuration, even in a case where the recording unit is displaced in the approaching and separating direction by the driving unit, the first engagement portion can engage with the first connection portion.

In the recording apparatus, it is preferable that the second engagement portion have a protrusion piece which is inserted into the second connection portion when engaging with the second connection portion, the second connection portion have a receiving surface with which the protrusion piece is in contact when the cutter unit moves in the width direction together with the recording unit, and the protrusion piece and the receiving surface be disposed so as to overlap with each other in the approaching and separating direction.

According to the configuration, even in a case where the recording unit is displaced in the approaching and separating direction by the driving unit, the second engagement portion can engage with the second connection portion.

In the recording apparatus, it is preferable that the cutter unit have a pressing member that presses the first engagement portion from the cutter unit side toward the recording unit side.

According to the configuration, engagement of the first connection portion and the first engagement portion can be strengthened with each other.

In the recording apparatus, it is preferable that the cutter unit have a holding body that holds a cutter blade for cutting the medium and a moving body that is movable in the width direction and to which the holding body is attached, and at least one of the first engagement portion and the second engagement portion be provided on the holding body.

According to the configuration, at least one of the first engagement portion and the second engagement portion can be also exchanged together with the holding body by removing the holding body from the moving body, and the maintainability thereof can be improved as compared with the configuration to exchange each cutter unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a recording apparatus having a cutting mechanism will be described with reference to the drawings.

Figure 1:
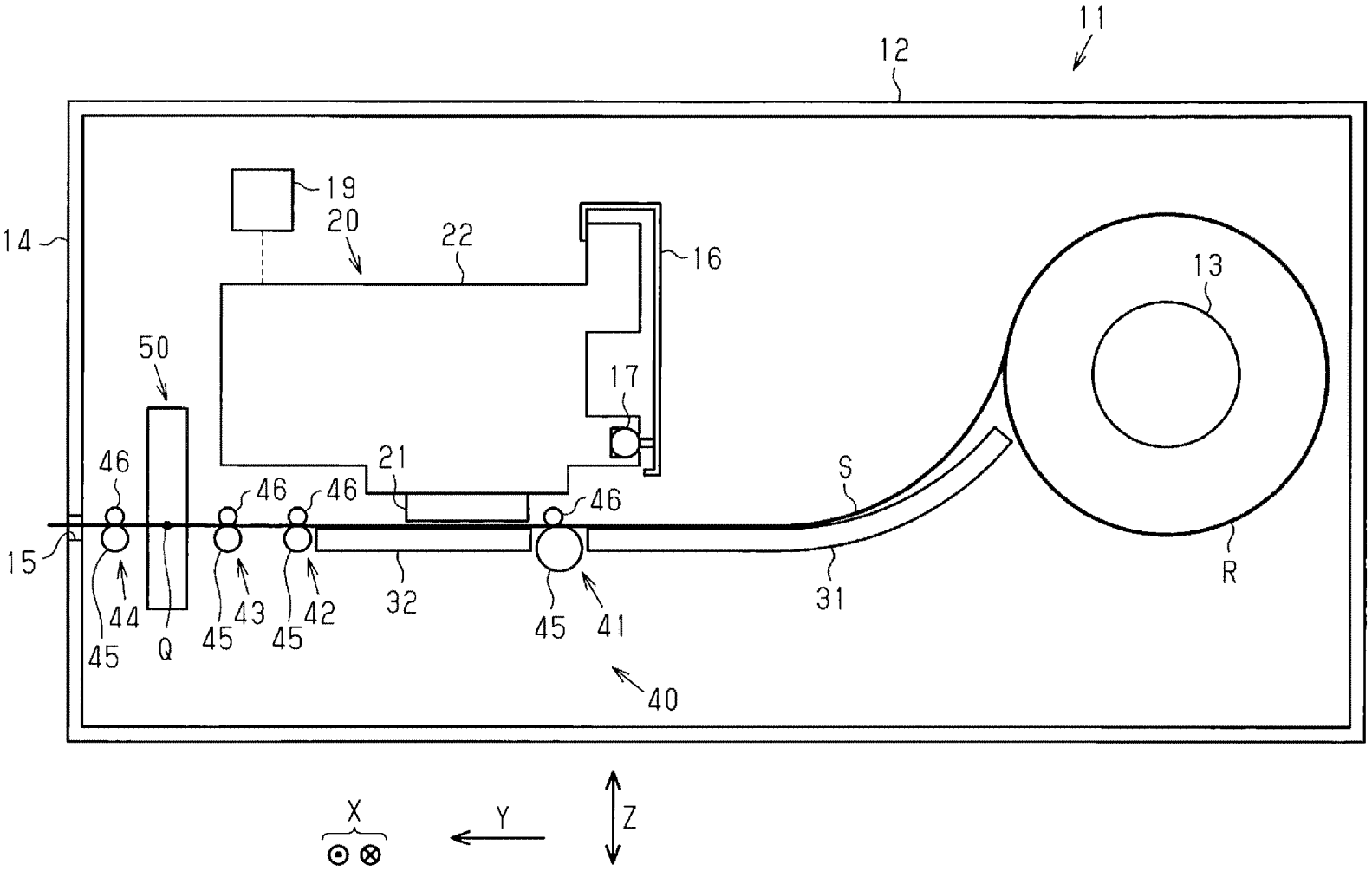
FIG. 1 is a side view schematically illustrating an internal structure of an embodiment of a recording apparatus having a cutting mechanism.

As illustrated in FIG. 1, the recording apparatus 11 has a rectangular parallelepiped housing 12. The recording apparatus 11 includes a recording unit 20 that records images such as characters and photographs on the medium S and a first support member 31 and a second support member 32 that support the medium S in the housing 12. The recording apparatus 11 includes a transport unit 40 which transports the medium S and a cutting mechanism 50 which cuts the medium S recorded by the recording unit 20 in the housing 12. In other words, the recording unit 20, the first and second support members 31 and 32, the transport unit 40, and the cutting mechanism 50 are accommodated in the housing 12.

In the housing 12, for example, a roll body R on which a medium S as a sheet is wound in a roll form is disposed. The roll body R is disposed behind an inside of the housing 12 which is on the right side in FIG. 1. The roll body R is rotatably supported by a shaft 13 provided so as to extend in a width direction X of the medium S. In this embodiment, as the shaft 13 is rotated in the counterclockwise direction in FIG. 1, the medium S is unwound from the roll body R. The unwound medium S is transported by the transport unit 40 and discharged from the inside of the housing 12 to the outside of the housing 12 through a discharge port 15 opening on the front surface 14 of the housing 12. In other words, in this embodiment, the direction from a rear side to a front side of the housing 12, the direction from a right side to a left side in FIG. 1 is the transport direction Y of the medium S transported by the transport unit 40. The front surface 14 of the housing 12 is a surface having a spread in the vertical direction Z and the width direction X.

The recording unit 20 includes a head 21 which ejects liquid such as ink, for example, toward the medium S and a carriage 22 which mounts the head 21. The carriage 22 is supported by a frame 16 which is provided in the housing 12 and a guide shaft 17 which is attached to the frame 16. The guide shaft 17 extends in the width direction X of the medium S. The carriage 22 is movable along the guide shaft 17. In other words, the carriage 22 is movable in the width direction X. In this embodiment, the carriage 22 functions as an example of a moving unit included in the recording unit 20. By moving the carriage 22 along the guide shaft 17, the head 21 can eject liquid onto the medium S over the entire region in the width direction X.

The first and second support members 31 and 32 are formed of plate-like members. The first support member 31 is disposed on the upstream side of the second support member 32 in the transport direction Y and guides the medium S unwound from the roll body R toward the recording unit 20. The second support member 32 is disposed to face the head 21 of the recording unit 20. The recording apparatus 11 according to this embodiment is provided with a driving unit 19 for moving the recording unit 20 in the vertical direction Z so as to change the distance between the recording unit 20 and the second support member 32. The recording apparatus 11 changes the position of the recording unit 20 with respect to the second support member 32, for example, according to the thickness of the medium S to be transported by the driving unit 19. In other words, the recording unit 20 is movable in the approaching and separating direction, which is a direction approaching or separating from the second support member 32. In this embodiment, the approaching and separating direction in which the recording unit 20 approaches or separates from the second support member 32 coincides with the vertical direction Z.

The transport unit 40 transports the medium S unwound from the roll body R toward the discharge port 15 from the inside of the housing 12 so as to be along the first and second support members 31 and 32. The transport unit 40 has a first transport roller pair 41, a second transport roller pair 42, a third transport roller pair 43, and a fourth transport roller pair 44 in order from the upstream side to the downstream side in the transport direction Y. The first transport roller pair 41 is disposed on the upstream side of the head 21 in the transport direction Y and is disposed at a position between the first support member 31 and the second support member 32. The second, third, and fourth transport roller pairs 42, 43, and 44 are disposed on the downstream side of the head 21 in the transport direction Y.

The first, second, third, and fourth transport roller pairs 41, 42, 43, and 44 include a driving roller 45 which can be driven and rotated by a motor (not illustrated), a driven roller 46 which can be driven and rotated with respect to the rotation of the driving roller 45. The first, second, third, and fourth transport roller pairs 41, 42, 43, and 44 transport the medium S by rotating in a state of interposing the medium S between the driving roller 45 and the driven roller 46. The driving roller 45 is disposed so as to contact the medium S from below. The driven roller 46 is disposed so as to be in contact with the medium S from above. In other words, the driven roller 46 in the second, third, and fourth transport roller pairs 42, 43, and 44 are in contact with a surface onto which the liquid is ejected with respect to the medium S when the medium S is transported. Therefore, so as to reduce the deterioration of the quality of the image recorded on the medium S, the driven rollers 46 in the second, third, and fourth transport roller pairs 42, 43, and 44 are configured with star wheels or the like which have a small contact area with respect to the medium S. A plurality of first, second, third, and fourth transport roller pairs 41, 42, 43, and 44 are disposed at predetermined intervals in the width direction X, respectively.

The cutting mechanism 50 is disposed between the third transport roller pair 43 and the fourth transport roller pair 44 in the transport direction Y. The medium S cut by the cutting mechanism 50 is transported by the fourth transport roller pair 44 and discharged from the discharge port 15. The recording apparatus 11 according to this embodiment is configured such that the interval in the vertical direction Z at the opening of the discharge port 15 is relatively small to the extent that the user cannot insert the hand into the housing 12 from the discharge port 15.

The recording apparatus 11 in this embodiment is normally used in a state of being installed on a horizontally spreading floor surface. The housing 12 of the recording apparatus 11 is provided in a rectangular parallelepiped shape such that the front surface 14 thereof crosses the floor surface and ideally is orthogonal to the floor surface. At this time, an orthogonal coordinate system including three axes of X axis, Y axis, and Z axis is considered, the floor surface on which the recording apparatus 11 is installed is a plane including the X-axis and the Y-axis, and a coordinate system is set so that the front surface 14 of the housing 12 becomes a plane including an X-axis and a Z-axis. Then, the width direction X coincides with the direction in which the X-axis extends, the transport direction Y coincides with the direction in which the Y-axis extends, and the vertical direction Z coincides with the direction in which the Z-axis extends. The X-axis extending in the width direction X, the Y-axis extending in the transport direction Y, and the Z-axis extending in the vertical direction Z have a relationship of being orthogonal to each other. In other words, in this embodiment, the width direction X, the transport direction Y, and the vertical direction Z respectively indicate three different directions from each other.

Next, the cutting mechanism 50 will be described.

Figure 2:
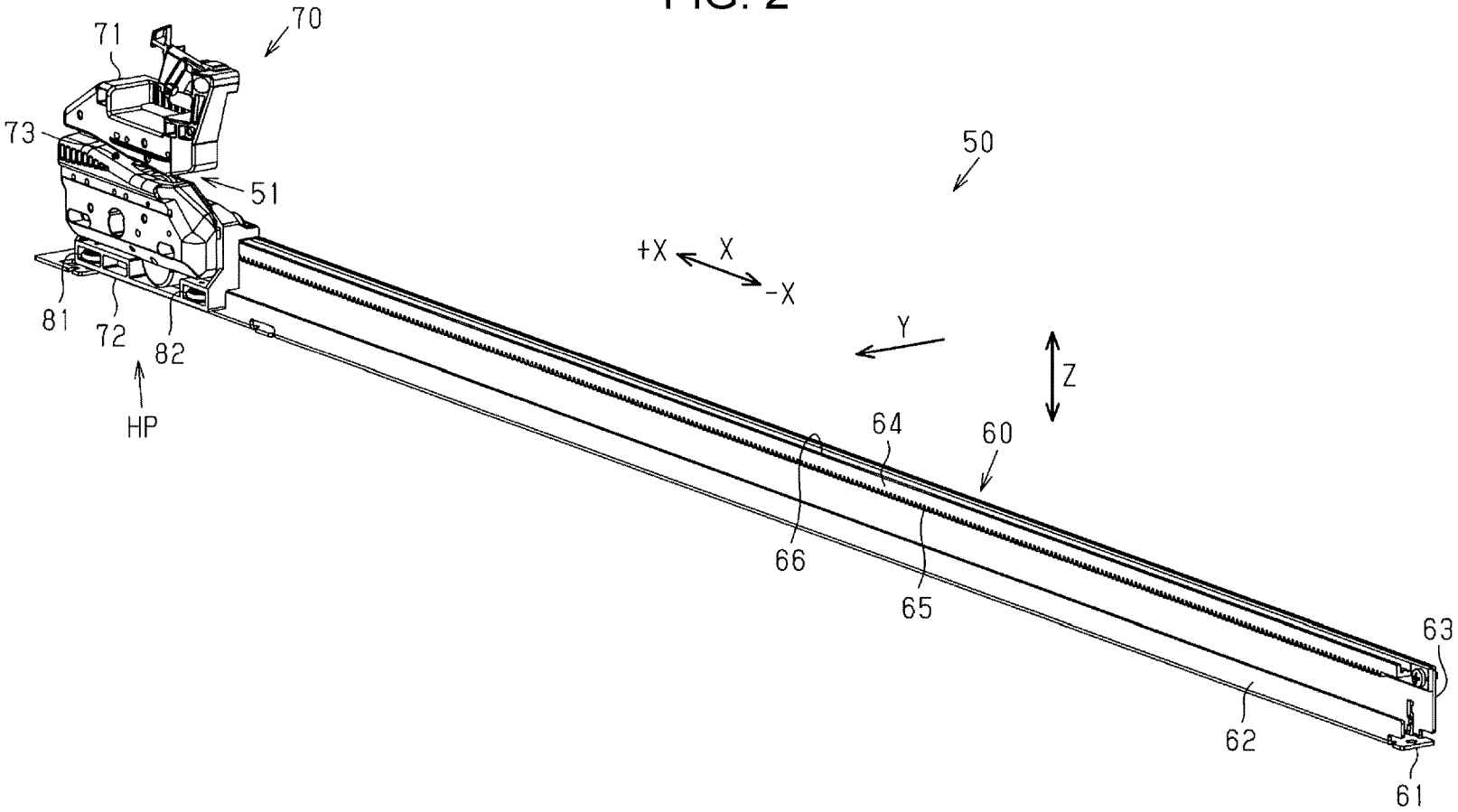
FIG. 2 is a perspective view of the cutting mechanism.

As illustrated in FIG. 2, the cutting mechanism 50 has a cutter blade 51 for cutting the medium S, a cutter unit 70 to which the cutter blade 51 is attached, and a guide frame 60 which supports the cutter unit 70. The guide frame 60 extends in the width direction X so as to be longer than the roll body R that can be loaded by the recording apparatus 11. In other words, the longitudinal direction of the guide frame 60 coincides with the width direction X. The cutter unit 70 can reciprocate along the guide frame 60. The cutting mechanism 50 cuts the medium S by the cutter blade 51 as the cutter unit 70 moves along the guide frame 60. For convenience of explanation, in the width direction X, the left side in FIG. 2 is set as the +X side and the right side as the opposite side thereto is set to the −X side. In this embodiment, as illustrated in FIG. 2, in the guide frame 60, the end portion on the +X side in the width direction X is set as the home position HP of the cutter unit 70. In the recording apparatus 11 of this embodiment, the end portion on the −X side in the width direction X which is a side opposite to a side where a home position HP of the cutter unit 70 is located is set as a standby position of the recording unit 20.

The guide frame 60 is formed by bending a sheet metal. The guide frame 60 is formed in a claw-like shape when viewed from the width direction X. The guide frame 60 has a bottom wall 61 and a front wall 62 and a rear wall 63 which bend upward from the bottom wall 61 and extend. The front wall 62 is located on the downstream side of the rear wall 63 in the transport direction Y and extends from the bottom wall 61 so that its length is shorter than the rear wall 63 in the vertical direction Z.

The guide frame 60 has a rack gear 64 extending in the width direction X. The rack gear 64 is attached to a surface of the rear wall 63 of the guide frame 60 which is on the downstream side in the transport direction Y. The rack gear 64 is disposed along an upper edge of the rear wall 63 and is provided so that the length in the width direction X is slightly shorter than the guide frame 60. The rack gear 64 has a tooth 65 over the width direction X at a portion on the lower side thereof. The rack gear 64 has a groove 66 in the width direction X for guiding the movement of the cutter unit 70 in a portion on the upper side thereof.

Figure 3:
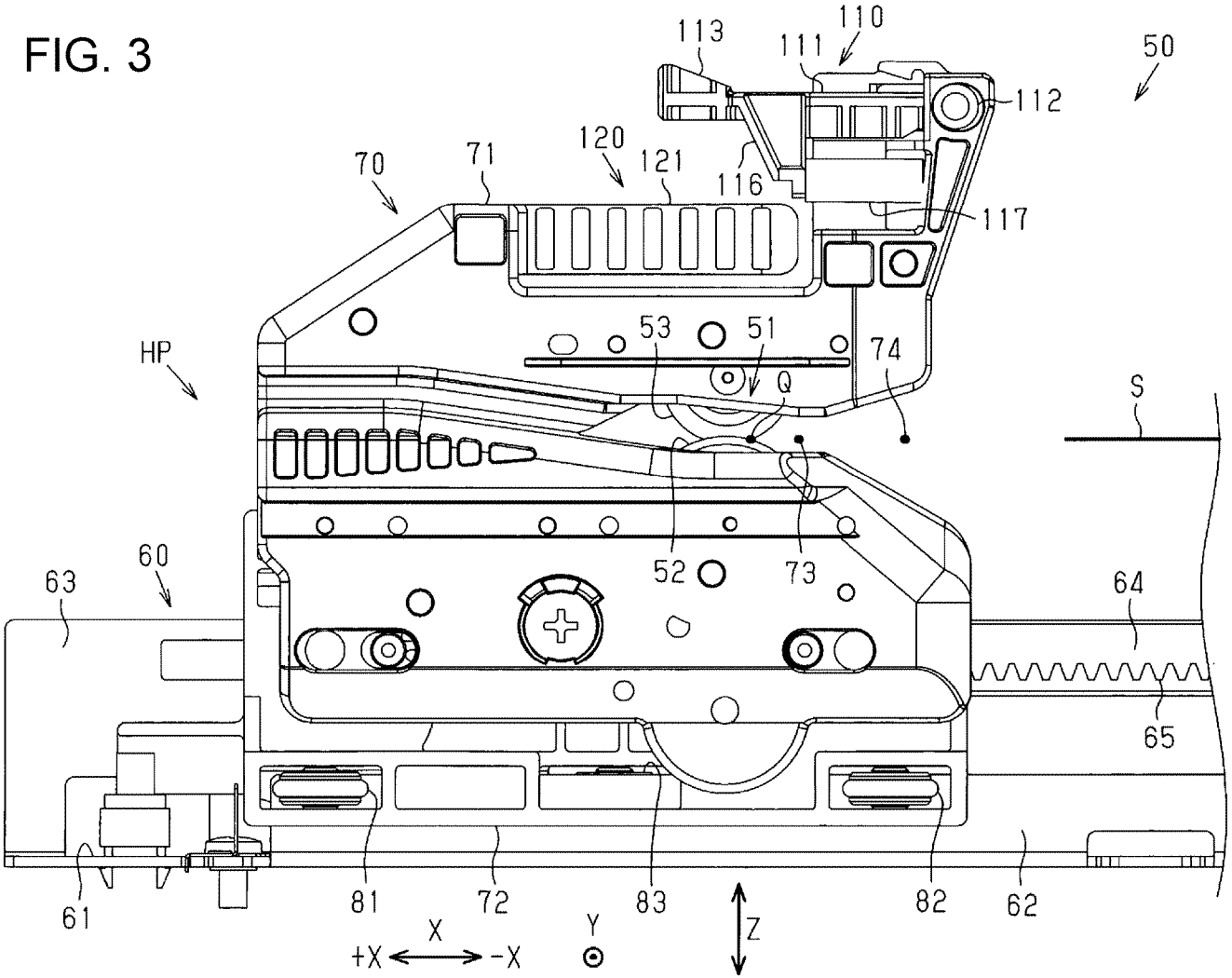
FIG. 3 is a front view of the cutting mechanism.

As illustrated in FIG. 2 and FIG. 3, the cutter unit 70 has a holding body 71 which holds the cutter blade 51 and a moving body 72 which is held on the guide frame 60. The cutter unit 70 illustrated in FIGS. 2 and 3 is located at the home position HP. The holding body 71 and the moving body 72 are fixed to each other so as to be capable of being handled integrally. The holding body 71 and the moving body 72 are fixed so that the portions thereof are overlapped with each other when viewed from the transport direction Y. Specifically, the holding body 71 and the moving body 72 are disposed so that the lower portion of the holding body 71 and the upper portion of the moving body 72 overlap each other in the vertical direction Z. Since the holding body 71 is detachable from the moving body 72, the holding body 71 can be replaced with respect to the moving body 72.

The holding body 71 is attached to a surface of the moving body 72 on the downstream side in the transport direction Y. The holding body 71 has a medium path 73 extending in the width direction X at a position above the moving body 72 in the vertical direction Z. The medium path 73 is a path through which the medium S passes through the holding body 71 when the cutter unit 70 moves in the width direction X along the guide frame 60. The portion of the medium path 73 on the −X side in the width direction X is an introduction port 74 for introducing the medium S into the medium path 73. So as to facilitate the introduction of the medium S into the medium path 73, the introduction port 74 is configured so that the opening in the vertical direction Z gradually increases from the +X side to the −X side in the width direction X.

The holding body 71 holds the cutter blade 51 at a position in the medium path 73 in the middle thereof. In other words, when the cutter unit 70 moves in the width direction X, the medium path 73 guides the medium S toward the cutter blade 51. The cutter blade 51 is disposed on the +X side of the introduction port 74 in the width direction X and is positioned adjacent to the introduction port 74. The cutter blade 51 is configured with a disk-shaped driving blade 52 and a driven blade 53. The driving blade 52 and the driven blade 53 are rotatably attached to the holding body 71. The driving blade 52 and the driven blade 53 are provided so as to be lined up in the vertical direction Z and disposed so as to interpose the medium path 73 therebetween. The driving blade 52 is positioned below the driven blade 53 in the vertical direction Z and is positioned on the downstream side of the driven blade 53 in the transport direction Y.

The cutter blade 51 is held by the holding body 71 in a state where the cutting edge which is the upper portion of the driving blade 52 and the cutting edge which is a lower side portion of the driven blade 53 are overlapped with each other when viewed from the transport direction Y. The cutting edge of the driving blade 52 and the cutting edge of the driven blade 53 are in contact with each other at a cutting position Q which is a position closer to the −X side in the width direction X among a portion in which the cutting edges overlap each other. The driving blade 52 in this embodiment is held by the holding body 71 in a posture in which the rotation shaft thereof is inclined by a predetermined angle with respect to the driven blade 53 extending in the transport direction Y. The cutter blade 51 cuts the medium S at the cutting position Q where the cutting edges of the driving blade 52 and the driven blade 53 are in contact with each other as the driving blade 52 and the driven blade 53 are rotated. In other words, when the cutter unit 70 moves from the +X side to the −X side in the width direction X, the cutting mechanism 50 interposes the medium S passing through the medium path 73 between the rotating driving blade 52 and the driven blade 53 and cut the medium S. The cutting mechanism 50 in this embodiment returns to the home position HP by moving from the −X side to the +X side after cutting the medium S by moving from the +X side to the −X side in the width direction X.

Figure 4:
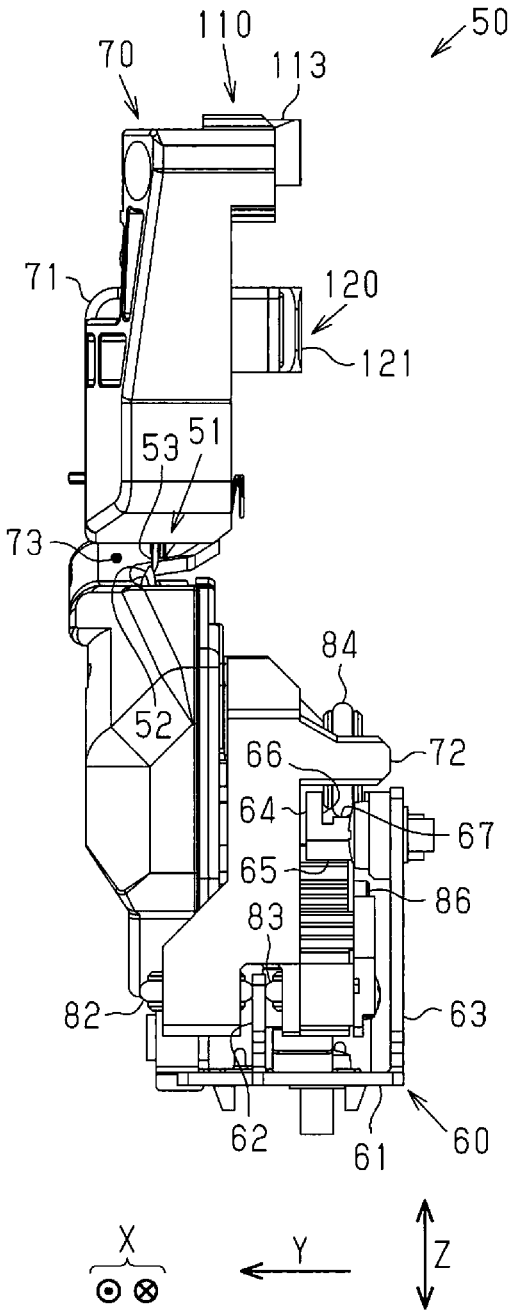
FIG. 4 is a side view of a cutting mechanism.

As illustrated in FIGS. 3 and 4, the moving body 72 has a first roller 81, a second roller 82, and a third roller 83 disposed to interpose the front wall 62 of the guide frame 60 at the lower portion thereof. The first and second rollers 81 and 82 are disposed on the front wall 62 so that peripheral surfaces thereof are in contact with a surface on the downstream side in the transport direction Y. The third roller 83 is disposed on the front wall 62 so that peripheral surface thereof is in contact with a surface on the upstream side in the transport direction Y. The first roller 81 is located at an end portion of the moving body 72 which is on the +X side in the width direction X and the second roller 82 is located at an end portion of the moving body 72 which is on the −X side in the width direction X. The third roller 83 is located between the first roller 81 and the second roller 82 in the width direction X. The first, second, and third rollers 81, 82, and 83 have rotation shafts thereof extending in the vertical direction Z and are rotated due to friction with the front wall 62 when the moving body 72 moves in the width direction X. In other words, the first, second and third rollers 81, 82, and 83 guide the movement of the cutter unit 70 along the front wall 62.

Figure 5:
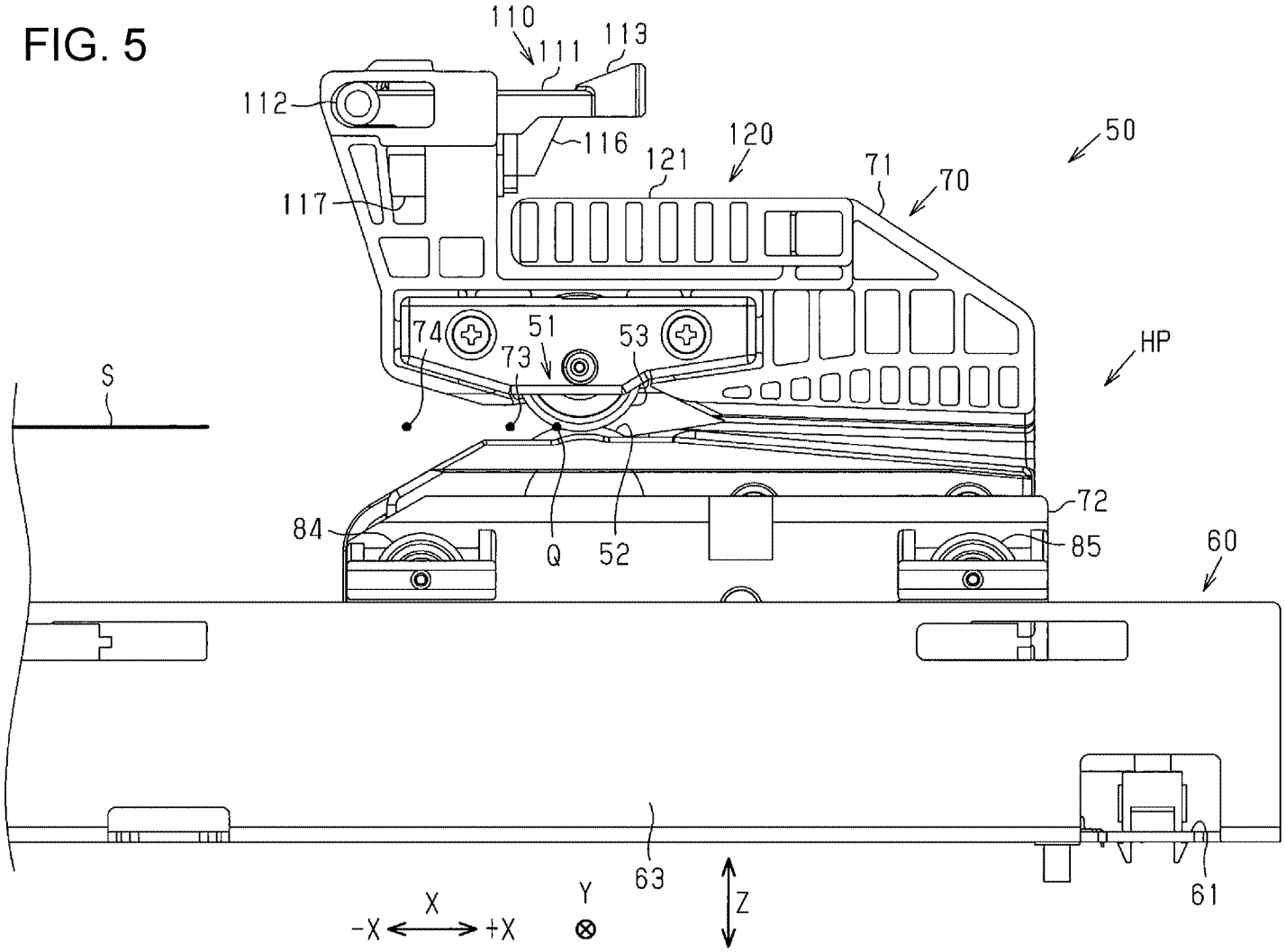
FIG. 5 is a rear view of a cutting mechanism.

As illustrated in FIG. 4 and FIG. 5, the moving body 72 has a fourth roller 84 and a fifth roller 85 disposed on an upper portion thereof so that a portion thereof fits in the groove 66 of the rack gear 64. The fourth and fifth rollers 84 and 85 are disposed such that peripheral surfaces thereof are in contact with the bottom surface 67 of the groove 66. The fourth roller 84 is located at the end portion on the −X side in the width direction X and the fifth roller 85 is located at the end portion on the +X side in the width direction X, in the moving body 72. The fourth and fifth rollers 84 and 85 are rotated by friction with the bottom surface 67 of the groove 66 when the rotating shaft thereof extends in the transport direction Y and the moving body 72 moves in the width direction X. In other words, the fourth and fifth rollers 84 and 85 guide the movement of the cutter unit 70 along the groove 66 of the rack gear 64. In summary, the first, second, third, fourth and fifth rollers 81, 82, 83, 84, and 85 guide the movement of the cutter unit 70 along the guide frame 60.

As illustrated in FIG. 4, the moving body 72 has a pinion gear 86 that can mesh with the teeth 65 of the rack gear 64. The pinion gear 86 is rotatably attached to the moving body 72. When the cutter unit 70 moves in the width direction X along the guide frame 60, the pinion gear 86 rotates while meshing with the teeth 65 of the rack gear 64. The cutter unit 70 has a transmission gear (not illustrated) which transmits the rotation of the pinion gear 86 to the driving blade 52. In other words, when the cutter unit 70 moves in the width direction X along the guide frame 60, the cutter unit 70 is configured so that the driving blade 52 rotates according to the rotation of the pinion gear 86. In FIG. 3 of this embodiment, when the cutter unit 70 moves from the +X side to the −X side in the width direction X, the driving blade 52 is configured to rotate in the counterclockwise direction. The driven blade 53 is driven and rotates according to the rotation of the driving blade 52 as cutting edge thereof is in contact with the cutting edge of the driving blade 52. In other words, while being rotated, the driving blade 52 and the driven blade 53 interpose the medium S between the cutting edge of the driving blade 52 and the cutting edge of the driven blade 53 and then cut the medium S.

Figure 6:
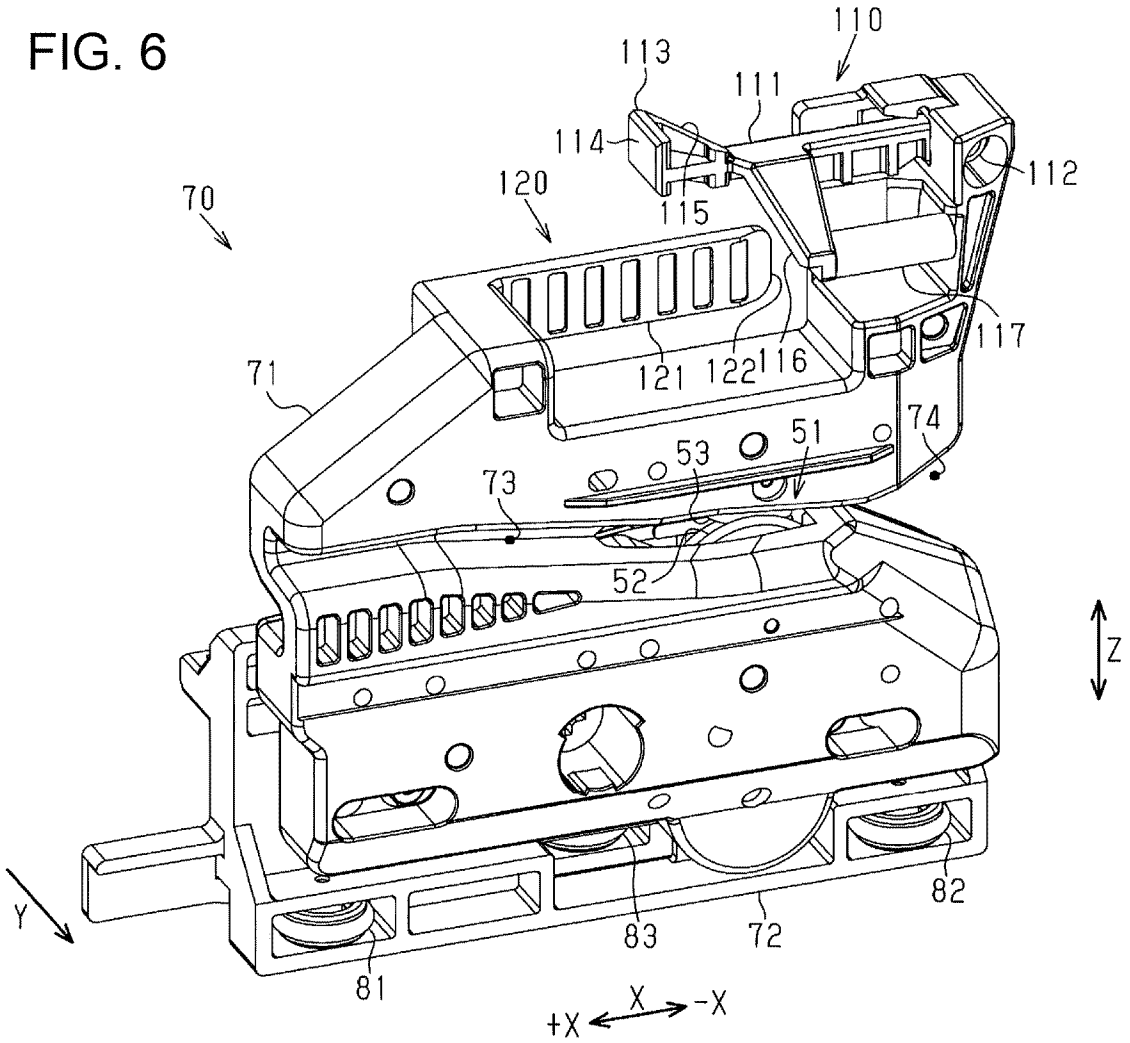
FIG. 6 is a perspective view illustrating a cutter unit.

As illustrated in FIG. 6, the holding body 71 has a first engagement portion 110 and a second engagement portion 120 for connecting the cutter unit 70 to the recording unit 20 on the upper portion thereof. In other words, the cutter unit 70 is configured to be connectable to the recording unit 20. The cutter unit 70 is connected to the recording unit 20 via the first and second engagement portions 110 and 120 so that it is possible for the cutter unit 70 can move in the width direction X according to the movement of the carriage 22 constituting the recording unit 20.

The first engagement portion 110 is located above the second engagement portion 120 in the vertical direction Z. The first engagement portion 110 has a lever 111 extending from the holding body 71 toward the +X side in the width direction X. A proximal end of the lever 111 which is on the −X side in the width direction X is attached to the holding body 71 via the joint 112. The lever 111 can swing in the transport direction Y and the vertical direction Z about the joint 112 as a fulcrum. The lever 111 has an engagement claw 113 which extends toward the upstream side in the transport direction Y at a distal end opposite to the proximal end thereof. The engagement claw 113 is provided in a substantially triangular shape when viewed from above in the vertical direction Z. The engagement claw 113 has a flat surface 114 at a portion that is on the +X side in the width direction X and an inclined surface 115 at a portion that is on the −X side. The flat surface 114 is a surface having a spread in the transport direction Y and the vertical direction Z. The inclined surface 115 is a surface that obliquely extends from the +X side to the −X side in the width direction X and from the upstream side to the downstream side in the transport direction Y.

The first engagement portion 110 has an arm 116 which extends obliquely toward the downstream side in the transport direction Y and the lower side in the vertical direction Z at a midway portion from the proximal end toward the distal end of the lever 111. The arm 116 extends from a position adjacent to the engagement claw 113 in the lever 111. The first engagement portion 110 includes a pressing member 117 configured with, for example, a coil spring. The pressing member 117 is attached to the distal end of an arm 116 extending from the lever 111. The pressing member 117 is attached to the holding body 71 at a position on the downstream side in the transport direction Y and on the lower side in the vertical direction Z than a position where the joint 112 is provided. The first engagement portion 110 is configured so that the lever 111 is pushed toward the upstream side in the transport direction Y and the upper side in the vertical direction Z via the arm 116 by the pressing member 117. In other words, the first engagement portion 110 is configured so that the engagement claw 113 is pressed from the cutter unit 70 side toward the recording unit 20 side with the joint 112 as a fulcrum by the pressing member 117.

The second engagement portion 120 has a plate-like protrusion piece 121 extending from the holding body 71 toward the −X side in the width direction X. The protrusion piece 121 extends so that a distal end portion 122 thereof on the −X side in the width direction X overlaps the lever 111 of the first engagement portion 110 in the vertical direction Z.

Figure 7:
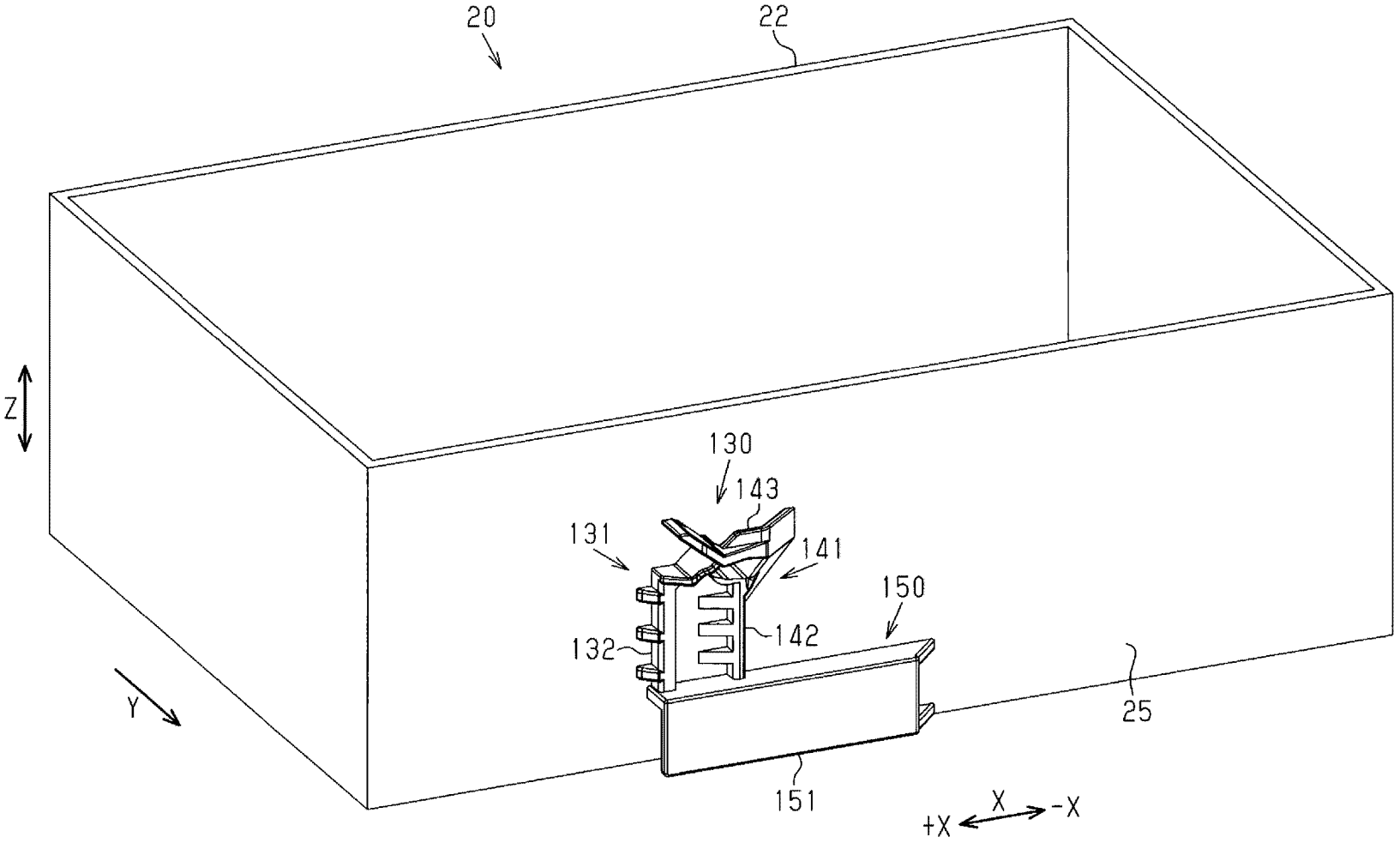
FIG. 7 is a schematic perspective view illustrating a carriage.

As illustrated in FIG. 7, the recording unit 20 has a first connection portion 130 and a second connection portion 150 for connecting with the cutter unit 70. The first and second connection portions 130 and 150 are provided on the carriage 22 constituting the recording unit 20. The first connection portion 130 is engageable with the first engagement portion 110 of the cutter unit 70. The second connection portion 150 is engageable with the second engagement portion 120 of the cutter unit 70. In other words, the recording unit 20 and the cutter unit 70 are connected with each other by engaging the first and second engagement portions 110 and 120 and the first and second connection portions 130 and 150 with each other.

The first and second connection portions 130 and 150 are provided on a side surface 25 on the downstream side of the carriage 22 in the transport direction Y. In other words, the first and second connection portions 130 and 150 are provided on the side surface 25 of the carriage 22 facing the cutting mechanism 50 in the transport direction Y. In the recording unit 20 in FIG. 7, only the carriage 22 is illustrated with the head 21 omitted.

Figure 8:
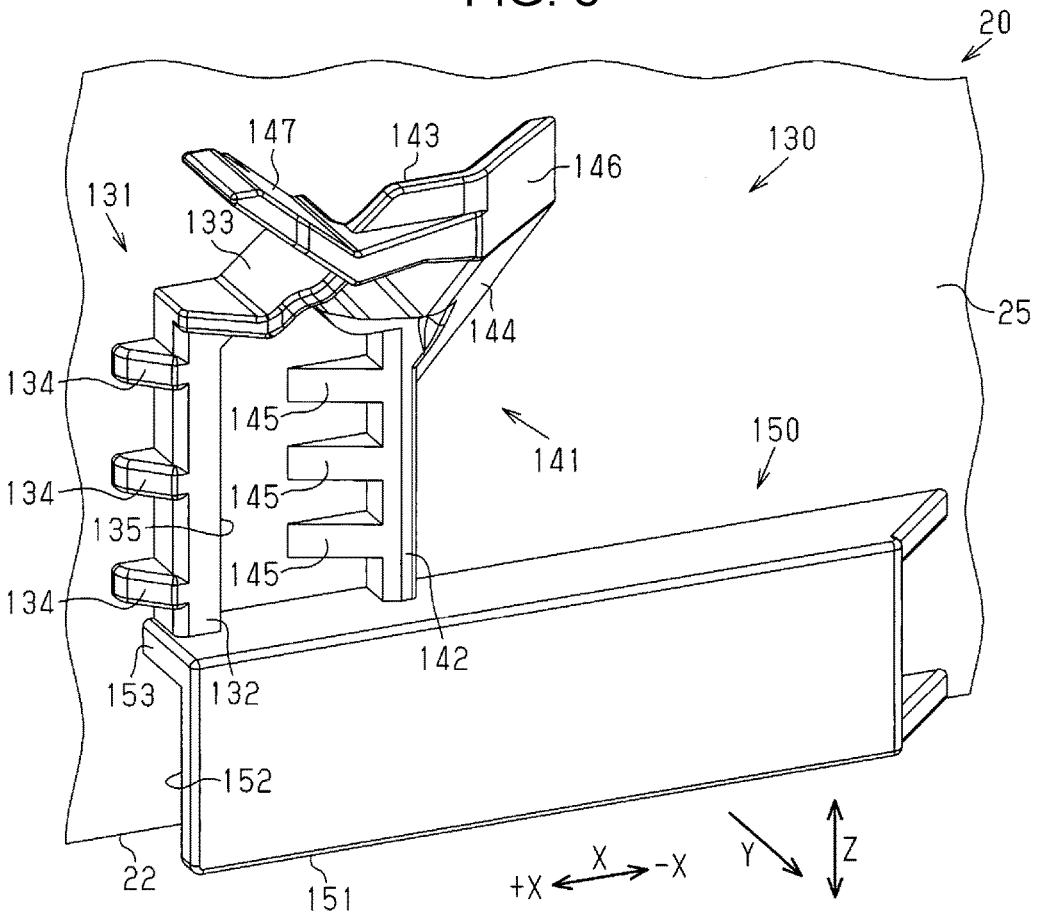
FIG. 8 is an enlarged view illustrating a first connection portion and a second connection portion in FIG. 7.

As illustrated in FIG. 8, the first and second connection portions 130 and 150 are disposed so as to be lined up in the vertical direction Z on the side surface 25 of the carriage 22. The first connection portion 130 is located directly above the second connection portion 150 on the side surface 25 of the carriage 22. The first connection portion 130 is brought into engagement with the first engagement portion 110 by being in contact with the first engagement portion 110. The first connection portion 130 has a receiving portion 131 for receiving the engagement claw 113 of the first engagement portion 110 engaging with the first connection portion 130. The first connection portion 130 has a guide portion 141 which guides the engagement claw 113 of the first engagement portion 110 so as to release the engagement between the first connection portion 130 and the first engagement portion 110. The receiving portion 131 and the guide portion 141 are provided so as to be lined up in the width direction X on the side surface 25 of the carriage 22. The receiving portion 131 is disposed closer to the +X side in the width direction X than the guide portion 141.

The receiving portion 131 has a receiving rib 132 which extends in the vertical direction Z and a receiving wall 133 which extends from the upper portion of the receiving rib 132 toward the −X side in the width direction X. The receiving portion 131 has a plurality of inclined ribs 134 extending from a position on the +X side of the receiving rib 132 in the width direction X to the +X side. The inclined rib 134 extends while inclining from the side surface 25 of the carriage 22 toward the top surface of the receiving rib 132. In other words, the top surface of the receiving rib 132 is continuous with the top surface of the inclined rib 134.

The wall surface 135 of the receiving rib 132 on the −X side in the width direction X functions as a receiving section of the first connection portion 130 with which the first engagement portion 110 is in contact when the cutter unit 70 moves in the width direction X according to the movement of the carriage 22. Specifically, when the cutter unit 70 moves in the width direction X together with the recording unit 20, in the first engagement portion 110 and the flat surface 114 of the engagement claw 113 is in contact with the wall surface 135 of receiving rib 132 constituting the first connection portion 130. In other words, the flat surface 114 of the engagement claw 113 functions as a contact portion that is in contact with the receiving section of the first connection portion 130 when the cutter unit 70 moves in the width direction X together with the recording unit 20. In this embodiment, the wall surface 135 of the receiving rib 132 functioning as a receiving section is configured so that the width in the vertical direction Z is larger than the flat surface 114 of the engagement claw 113 functioning as a contact portion. In other words, the wall surface 135 of the receiving rib 132 has a larger width in the approaching and separating direction than the flat surface 114 of the engagement claw 113.

The guide portion 141 has a guide rib 142 which extends in the vertical direction Z and a guide piece 143 which is located above the guide rib 142. The guide portion 141 has an inclined surface 144 continuous with the upper portion of the guide rib 142 and the guide piece 143. The guide portion 141 has a plurality of inclined ribs 145 which extends in the width direction X from the portion on the +X side in the width direction X in the guide rib 142. The guide ribs 142 are disposed with a predetermined interval in the width direction X from the receiving rib 132 of the receiving portion 131. The inclined rib 145 extends while inclining from the side surface 25 of the carriage 22 toward the top surface of the guide rib 142. In other words, the top surface of the guide rib 142 is continuous with the top surface of the inclined rib 145.

The guide piece 143 extends toward the +X side with the portion on the −X side in the width direction X as the proximal end portion 146. The proximal end portion 146 is continuous with the top surface of the guide rib 142 via the inclined surface 144. In the guide piece 143, a portion that is on the +X side in the width direction X, that is, a distal end portion 147 that is side opposite to the proximal end portion 146, extends obliquely to an upper side in the vertical direction Z from the −X side to the +X side in the width direction X. The guide piece 143 extends so that distal end portion 147 thereof is located above the receiving rib 132.

Figure 9:
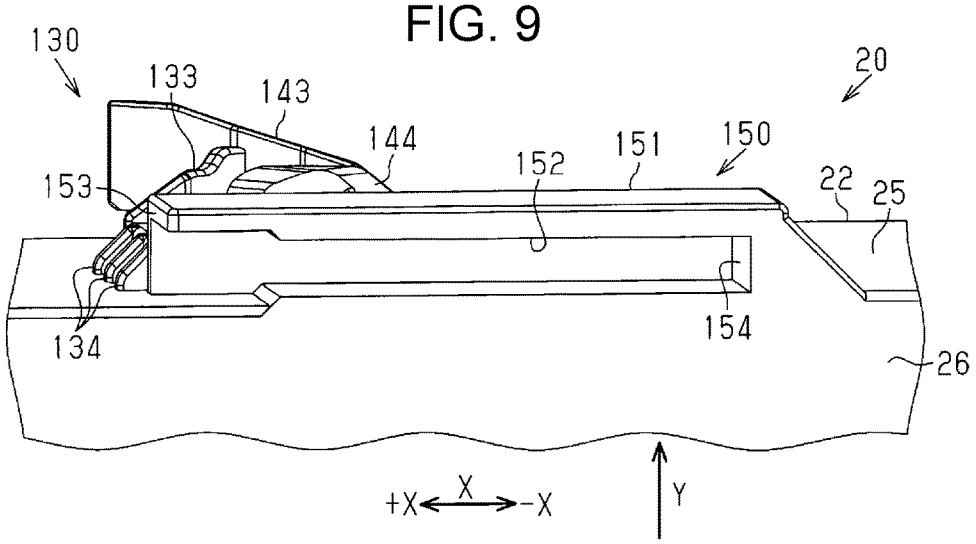
FIG. 9 is a perspective view illustrating the carriage when viewing the second connection portion from below.

As illustrated in FIGS. 8 and 9, the second connection portion 150 has a holder 151 which can accommodate the protrusion piece 121 of the second engagement portion 120. The holder 151 is disposed along the lower edge of a side surface 25 of the carriage 22. In other words, the holder 151 is provided so as to be continuous with the bottom surface 26 of the carriage 22. The holder 151 has a groove 152 into which the protrusion piece 121 is inserted. The groove 152 is formed so as to open on an end surface 153 on the +X side in the width direction X in the holder 151 and on the lower surface in the vertical direction Z continuous with the bottom surface 26 of the carriage 22. In other words, the second connection portion 150 is engaged with the second engagement portion 120 by accommodating the protrusion piece 121 in the holder 151 via the groove 152.

A surface of the holder 151, which is located at the innermost side among the surfaces constituting the groove 152 serves as a receiving surface 154 with which the second engagement portion 120 is in contact, when the cutter unit 70 is moved in the width direction X according to the movement of the carriage 22. The receiving surface 154 is a surface located on the −X side in the width direction X among the surfaces constituting the groove 152 in the holder 151. In other words, when the cutter unit 70 is moved together with the recording unit 20 in the width direction X, the distal end portion 122 of the protrusion piece 121 constituting the second engagement portion 120 is formed so as to be capable of being in contact with the receiving surface 154. The protrusion piece 121 of the second engagement portion 120 of the cutter unit 70 and the receiving surface 154 of the second connection portion 150 of the carriage 22 have a certain length with respect to the vertical direction Z, respectively. In other words, it can be said that the protrusion piece 121 and the receiving surface 154 are disposed so as to overlap with each other in the approaching and separating direction even if the positions in the approaching and separating direction vary to some extent, respectively.

Next, the operation of the recording apparatus 11 configured as described above will be described focusing on a case where the cutter unit 70 moves in the width direction X in particular. In the initial state, in the width direction X, the cutter unit 70 is located at the home position HP at the +X side, and the recording unit 20 is at the standby position at the −X side.

When the cutting mechanism 50 cuts the medium S, the carriage 22 of the recording unit 20 moves from the standby position of the recording unit 20 toward a position corresponding to the home position HP of the cutter unit 70 so as to connect with the cutter unit 70. When the carriage 22 is moved from the standby position to the +X side in the width direction X, the first engagement portion 110 of the cutter unit 70 is in contact with the side surface 25 of the carriage 22. Specifically, the engagement claw 113 of the lever 111 constituting the first engagement portion 110 is in contact with the side surface 25 of the carriage 22. At this time, the lever 111 is pressed against the recording unit 20 side by the pressing member 117. Therefore, the carriage 22 is moved toward the +X side in the width direction X in a state where the engagement claw 113 is pressed against the side surface 25 thereof.

When the carriage 22 moves to the +X side in the width direction X in a state where the engagement claw 113 is in contact with the side surface 25, the engagement claw 113 is in contact with the first connection portion 130 provided on the side surface 25 of the carriage 22. Specifically, the engagement claw 113 is in contact with the inclined rib 134 constituting the first connection portion 130. When the carriage 22 further moves to the +X side in the width direction X in a state where the engagement claw 113 is in contact with the inclined rib 134, the engagement claw 113 climbs over the inclined rib 134 and the receiving rib 132 and is in contact with the side surface 25 between the receiving rib 132 and the guide rib 142. At this time, the carriage 22 is located at a position corresponding to the home position HP of the cutter unit 70. The protrusion piece 121 of the second engagement portion 120 is inserted into the groove 152 of the holder 151 of the second connection portion 150 as the carriage 22 moves to the +X side in the width direction X. In other words, the cutter unit 70 is connected to the recording unit 20 by moving the recording unit 20 to the end portion on the +X side in the width direction X.

Figure 10:
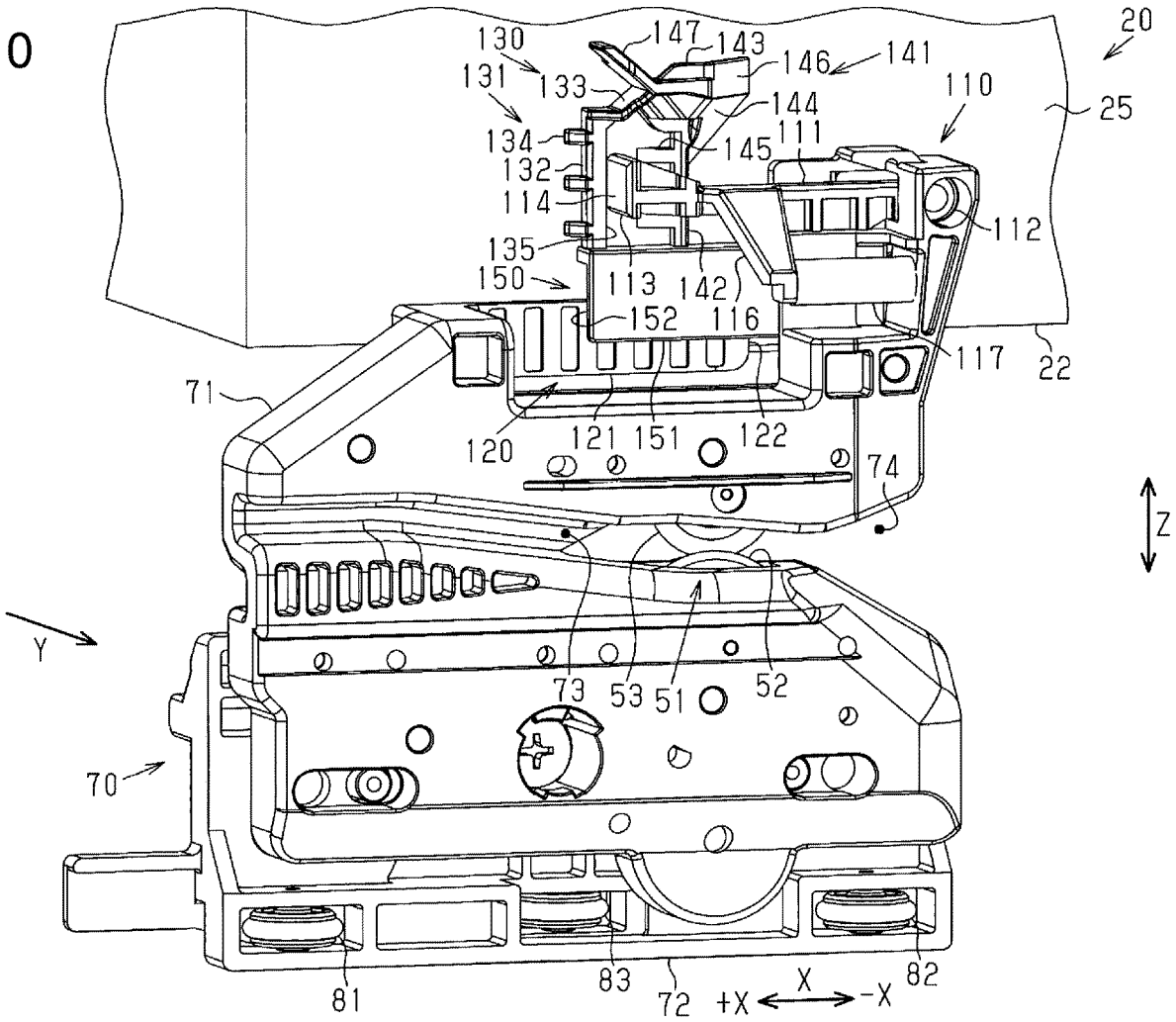
FIG. 10 is a perspective view illustrating when the cutter unit is moved from +X side to −X side in a width direction X.

As illustrated in FIG. 10, next, in a state where the cutter unit 70 and the recording unit 20 are connected with each other, so as to move the cutter unit 70 from the +X side to the −X side in the width direction X, the carriage 22 moves toward the −X side. When the carriage 22 located at the +X side end portion in the width direction X moves toward the −X side, the wall surface 135 of the receiving rib 132 is in contact with the engagement claws located between the receiving rib 132 and the guide rib 142 113. Specifically, the wall surface 135 of the receiving rib 132 is in contact with the flat surface 114 of the engagement claw 113. In other words, the contact portion of the first engagement portion 110 is in contact with the receiving section of the first connection portion 130 and is received. At this time, the protrusion piece 121 of the second engagement portion 120 is inserted into the groove 152 of the holder 151 to such an extent that the distal end portion 122 thereof is not in contact with the receiving surface 154.

As the receiving ribs 132 receive the engagement claws 113, the cutter unit 70 moves from the +X side to the −X side in the width direction X according to the movement of the carriage 22. As the cutter unit 70 moves from the +X side to the −X side in the width direction X, the cutter blade 51 cuts the medium S passing through the medium path 73.

While the cutter unit 70 moves from the +X side to the −X side in the width direction X, the lever 111 which is in contact with the receiving rib 132 is swung upward with the joint 112 as a fulcrum by the pressing member 117. When the lever 111 swings upward in a state where the engagement claw 113 is located between the receiving rib 132 and the guide rib 142, there is a fear that contact between the flat surface 114 of the engagement claw 113 and the wall surface 135 of the receiving rib 132 cannot be kept.

In this respect, the recording apparatus 11 according to this embodiment is provided with a receiving wall 133 for receiving the lever 111 swinging upward by the pressing member 117. Even when the lever 111 swings upward by the pressing member 117 in a state where the engagement claw 113 is located between the receiving rib 132 and the guide rib 142, the lever 111 is received by the receiving wall 133. In other words, while the carriage 22 moves from the +X side to the −X side in the width direction X, the receiving wall 133 receives the lever 111, whereby contact between the flat surface 114 of the engagement claw 113 and the wall surface 135 of the receiving rib 132 is kept.

When the cutter unit 70 completes cutting of the medium S and ends the movement to the −X side in the width direction X, the carriage 22 moves from the −X side toward the +X side to return the cutter unit 70 to the home position HP.

Figure 11:
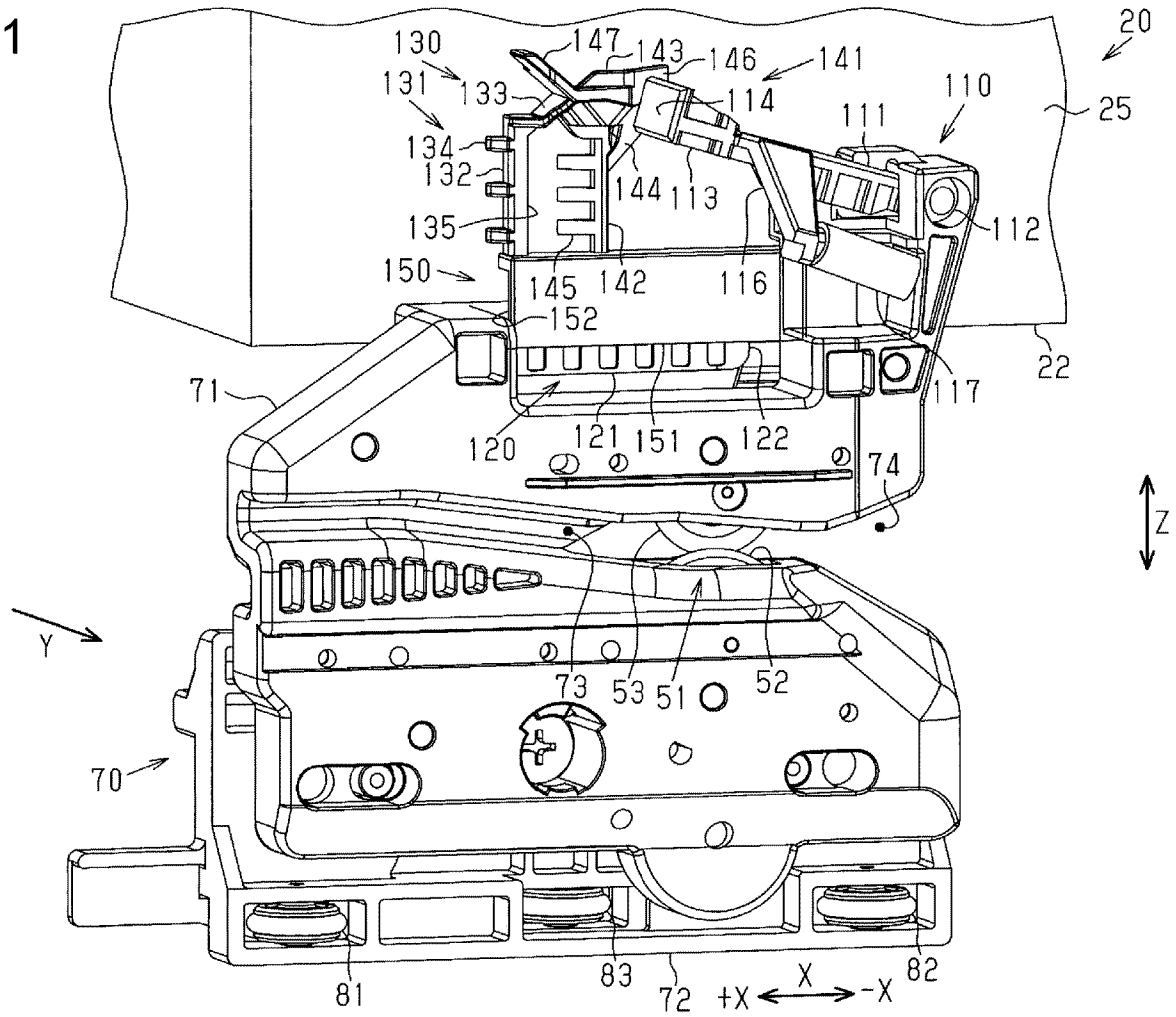
FIG. 11 is a perspective view illustrating when the cutter unit is moved from −X side to +X side in the width direction X.
Figure 12:
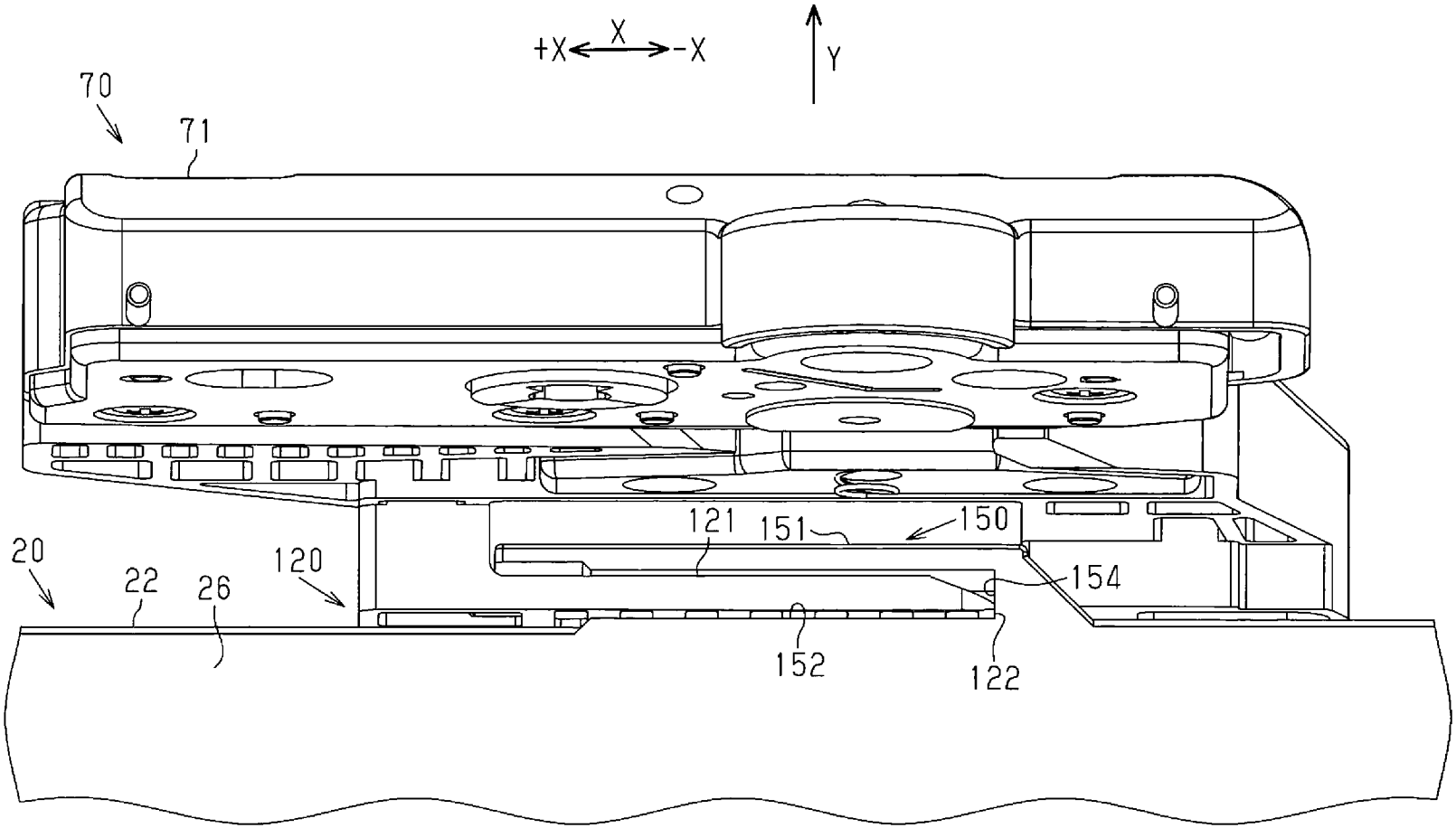
FIG. 12 is a perspective view illustrating when the cutter unit is moved from −X side to +X side in the width direction X.

As illustrated in FIGS. 11 and 12, when the carriage 22 moves to the +X side in the width direction X, the engagement claw 113 that is in contact with the wall surface 135 of the receiving rib 132 climbs over the inclined rib 145 and the guide rib 142. At this time, as the pressing member 117 pushes the lever 111 upward, the engagement claw 113 moves along the inclined surface 144 extending from the upper portion of the guide rib 142 and is guided toward the proximal end portion 146 of the guide piece 143. When the carriage 22 moves to the +X side in the width direction X, the distal end portion 122 of the protrusion piece 121 of the second engagement portion 120 is in contact with the receiving surface 154 of the second connection portion 150. In other words, the protrusion piece 121 of the second engagement portion 120 contacts the receiving surface 154 of the second connection portion 150 and is received therein. As the holder 151 receives the protrusion pieces 121, the cutter unit 70 is moved from the −X side to the +X side in the width direction X according to the movement of the carriage 22. In other words, in the cutter unit 70, the protrusion piece 121 of the second engagement portion 120 is pushed by the receiving surface 154 of the second connection portion 150 to move together with the recording unit 20 from the −X side to the +X side in the width direction X.

When the cutter unit 70 returns to the home position HP by the movement of the carriage 22, the carriage 22 moves toward the −X side in the width direction X so as to return to the standby position of the recording unit 20. At this time, as the carriage 22 moves to the −X side, the engagement claw 113 is guided from the proximal end portion 146 of the guide piece 143 to the distal end portion 147. Further, when the carriage 22 moves to the −X side, the engagement claw 113 climbs over the distal end portion 147 of the guide piece 143, and the first connection portion 130 and the first engagement portion 110 are not in contact with each other. In other words, by being guided by the guide portion 141, the engagement between the first engagement portion 110 and the first connection portion 130 is released. The protrusion piece 121 of the second engagement portion 120 is pulled out from the groove 152 as the carriage 22 moves to the −X side. In summary, when the recording unit 20 returns to the standby position after the cutter unit 70 returns to the home position HP, the connection between the cutter unit 70 and the recording unit 20 is released.

In short, the cutter unit 70 in this embodiment moves together with the carriage 22 from the +X side to the −X side in the width direction X by the first connection portion 130 and the first engagement portion 110. The cutter unit 70 in this embodiment moves together with the carriage 22 from the −X side to the +X side in the width direction X by the second connection portion 150 and the second engagement portion 120.

According to the embodiment described above, the following effects can be obtained.

(1) The first engagement portion 110 engages with the first connection portion 130 and the second engagement portion 120 engages with the second connection portion 150, whereby the cutter unit 70 and the recording unit 20 are connected with each other. Therefore, when the cutter unit 70 is moved together with the recording unit 20 in a state where the cutter unit 70 and the recording unit 20 are connected to each other, the load applied to the connection section is dispersed to the first engagement portion 110 and the second engagement portion 120. In other words, the connection between the cutter unit 70 and the recording unit 20 can be well kept. Therefore, the medium S can be accurately cut.

(2) So as to change the distance between the recording unit 20 and the second support member (support member) 32, the recording apparatus 11 includes a driving unit 19 for moving the recording unit 20 in the vertical direction (approaching and separating direction) Z. Therefore, by changing the distance between the recording unit 20 and the second support member 32 according to the thickness of the medium S, the quality of the image recorded on the medium S can be improved.

(3) The wall surface 135 (receiving section) of the first connection portion 130 has a larger width in the vertical direction (approaching and separating direction) Z than that of the flat surface 114 (contact portion) of the first engagement portion 110. Therefore, even in a case where the recording unit 20 is displaced in the vertical direction (approaching and separating direction) Z by the driving unit 19, the first engagement portion 110 can engage with the first connection portion 130.

(4) The protrusion piece 121 and the receiving surface 154 are disposed so as to overlap each other in the vertical direction (approaching and separating direction) Z. Therefore, even in a case where the recording unit 20 is displaced in the vertical direction (approaching and separating direction) Z by the driving unit 19, the second engagement portion 120 can engage with the second connection portion 150.

(5) The cutter unit 70 has a pressing member 117 which presses the first engagement portion 110 from the cutter unit 70 side toward the recording unit 20 side. Therefore, the engagement of the first connection portion 130 and the cutter unit 70 with each other by the first engagement portion 110 can be strengthened.

(6) At least one of the first engagement portion 110 and the second engagement portion 120 is provided on the holding body 71. Therefore, by removing the holding body 71 from the moving body 72, at least one of the first engagement portion 110 and the second engagement portion 120 can be exchanged together with the holding body 71, and as compared with a configuration exchanging each the cutter unit 70, maintainability thereof can be improved.

(7) When the cutter unit 70 is moved in the width direction X, in a case where the medium S is cut, the first engagement portion 110 and the first connection portion 130 operate, and in a case where the medium S returns to the home position HP, the second engagement portion 120 and the second connection portion 150 act. In other words, when the cutter unit 70 is moved while being connected to the recording unit 20, the load applied to the connection section can be more effectively dispersed by the first engagement portion 110 and the second engagement portion 120.

(8) When the cutter unit 70 moves from the +X side to the −X side in the width direction X, a portion of the protrusion piece 121 of the second engagement portion 120 is inserted into the groove 152 of the second connection portion 150. Therefore, even if there is a rattling between the cutter unit 70 and the guide frame 60, such a rattling can be suppressed by inserting the protrusion piece 121 into the groove 152 of the second connection portion 150.

The embodiment described above may be modified as follows. In addition, the following modification examples may be combined as appropriate.

At least one of the first engagement portion 110 and the second engagement portion 120 may be provided on the moving body 72 constituting the cutter unit 70.

The cutter unit 70 may be configured by integrally providing the holding body 71 and the moving body 72.

The recording apparatus 11 may not have the driving unit 19 for changing the distance between the recording unit 20 and the second support member 32. In other words, the distance between the recording unit 20 and the second support member 32 may be manually changeable.

The pressing member 117 is not limited to a coil spring, but may be a winding spring, for example. In addition, the pressing member is not limited to the spring, but an elastic body such as rubber may be adopted as the pressing member 117. The cutter blade 51 is not limited to a rotating blade, but may be a fixed blade.

The medium S is not limited to paper, but may be plastic film, metal film, cloth or the like.

The recording apparatus 11 may be a fluid ejecting apparatus that performs recording by ejecting or discharging another fluid other than ink (including a liquid, a liquid body in which particles of the functional material are dispersed or mixed in a liquid, a fluid body such as a gel, a solid that can be injected by flowing as a fluid). For example, the recording apparatus 11 may be a fluid ejecting apparatus that performs recording by ejecting a liquid body containing dispersed or dissolved materials such as electrode material and color material (pixel material) used for production or the like of liquid crystal display, electroluminescence (EL) display, or surface emitting display. In addition, the recording apparatus 11 may be a fluid ejecting apparatus that ejects a fluid body such as a gel (for example, a physical gel), a powdery particle ejecting apparatus (such as toner jet type recording apparatus) that ejects a solid, such as a powder (granular material) may be used. The present invention can be applied to any one of the fluid ejecting apparatuses. In the present specification, the term "fluid" means, for example, a liquid (including inorganic solvent, organic solvent, solution, liquid resin, liquid metal (metal melt), or the like), a liquid body, a fluid body, a granular body (including granular body and powder body) and the like.

This application claims priority under 35 U.S.C. § 119 to Japanese Patent Application No. 2017-059258, filed Mar. 24, 2017. The entire disclosure of Japanese Patent Application No. 2017-059258 is hereby incorporated herein by reference.

What is claimed is:

1. A recording apparatus comprising:

a recording unit that is configured to be capable of moving in a width direction of a medium and records an image on the medium; and a cutter unit that is configured to be connectable to the recording unit and cuts the medium by moving in the width direction while introducing the medium into a medium path, the cutter unit extending down further than the medium path, wherein the recording unit has a first connection portion and a second connection portion for connecting with the cutter unit, and wherein the cutter unit has a first engagement portion for engaging with the first connection portion and a second engagement portion for engaging with the second connection portion.

2. The recording apparatus according to claim 1, further comprising:

a support member that is disposed to face the recording unit and supports the medium; and a driving unit that moves the recording unit in approaching and separating direction which is a direction different from the width direction so as to change a distance between the recording unit and the support member.

3. The recording apparatus according to claim 2, wherein a receiving section of the first connection portion with which the first engagement portion is in contact when the cutter unit moves in the width direction together with the recording unit has a width in the approaching and separating direction which is larger than that of the contact portion of the first engagement portion which is in contact with the receiving section.

4. The recording apparatus according to claim 2, wherein the second engagement portion has a protrusion piece which is inserted into the second connection portion when engaging with the second connection portion, wherein the second connection portion has a receiving surface with which the protrusion piece is in contact when the cutter unit moves in the width direction together with the recording unit, and wherein the protrusion piece and the receiving surface are disposed so as to overlap with each other in the approaching and separating direction.

5. The recording apparatus according to claim 1, wherein the cutter unit has a pressing member that presses the first engagement portion from the cutter unit side toward the recording unit side.

6. The recording apparatus according to claim 1, wherein the cutter unit has a holding body that holds a cutter blade for cutting the medium and a moving body that is movable in the width direction and to which the holding body is attached, and wherein at least one of the first engagement portion and the second engagement portion is provided on the holding body.

7. The recording apparatus according to claim 1, the cutting unit having a lower rotary cutter rotatably mounted within a lower portion of the cutting unit for cutting the medium with medium path from below.

8. The recording apparatus according to claim 7,

The cutting unit having an upper rotary cutter rotatably mounted within an upper portion of the cutting unit for cutting the medium within the medium path from above.

9. The recording apparatus according to claim 8, the lower portion of the cutting unit defining a lower surface of the medium path, the upper portion of the cutting unit defining an upper surface of the medium path.

10. The recording apparatus according to claim 1, the cutting unit having an upper portion and a lower portion, the lower portion of the cutting unit defining a lower surface of the medium path, the upper portion of the cutting unit defining an upper surface of the medium path.

11. A recording apparatus comprising:

a recording unit that is configured to be capable of moving in a width direction of a medium and records an image on the medium; and a cutter unit that is configured to be connectable to the recording unit and cuts the medium by moving in the width direction while introducing the medium into a medium path, the cutter unit extending down further than the medium path, wherein the recording unit has a first connection portion and a second connection portion for connecting with the cutter unit, and wherein the cutter unit has a first engagement portion for engaging with the first connection portion and a second engagement portion for engaging with the second connection portion, the cutting unit being connectable to the recording unit by the recording unit moving towards the cutting unit in the width direction thereby engaging the first connection portion with the first engagement portion, and the second connection portion with the second engagement portion, the cutting unit being disconnected from the recording unit by the connected recording unit and cutting unit moving in the width direction to thereby disengage the first connection portion from the first engagement portion, and the second connection portion from the second engagement portion.

12. A recording apparatus comprising:

a recording unit that is configured to be capable of moving in a width direction of a medium and records an image on the medium; and a cutter unit that is configured to be connectable to the recording unit and cuts the medium by moving in the width direction, wherein the recording unit has a first connection portion and a second connection portion for connecting with the cutter unit, and wherein the cutter unit has a first engagement portion for engaging with the first connection portion and a second engagement portion for engaging with the second connection portion, the cutting unit being connectable to the recording unit by the recording unit moving towards the cutting unit in the width direction thereby engaging the first connection portion with the first engagement portion, and the second connection portion with the second engagement portion, the cutting unit being disconnected from the recording unit by the connected recording unit and cutting unit moving in the width direction to thereby disengage the first connection portion from the first engagement portion, and the second connection portion from the second engagement portion.

* * * * *